US005152163A

United States Patent [19]

Hawkes et al.

[11] Patent Number: 5,152,163

[45] Date of Patent: Oct. 6, 1992

[54] CONTINUOUS EXTRUSION APPARATUS

[75] Inventors: Daniel J. Hawkes, Ashford; Douglas E. Anderson, Canterbury; Phillip A. Jones, Ashford, all of England

[73] Assignee: BWE Limited, England

[21] Appl. No.: 634,199

[22] PCT Filed: May 18, 1990

[86] PCT No.: PCT/GB90,00778

§ 371 Date: Jan. 28, 1991

§ 102(e) Date: Jan. 28, 1991

[87] PCT Pub. No.: WO90/14176

PCT Pub. Date: Nov. 29, 1990

[30] Foreign Application Priority Data

May 18, 1989 [GB] United Kingdom ..... 8911466
Jun. 30, 1989 [GB] United Kingdom ..... 8915138

[51] Int. Cl.[5] ..... B21C 23/08
[52] U.S. Cl. ..... 72/262; 72/269
[58] Field of Search ..... 72/262, 269

[56] References Cited

U.S. PATENT DOCUMENTS

| | | | |
|---|---|---|---|
| 641,041 | 1/1900 | Royle | 72/262 |
| 2,135,194 | 11/1938 | Underhill . | |
| 3,240,047 | 3/1966 | Long et al. | 72/269 |
| 3,748,885 | 7/1973 | Creuzet . | |
| 4,277,968 | 7/1981 | Pardoe . | |
| 4,564,347 | 1/1986 | Vaughan | 72/262 |
| 4,578,973 | 4/1986 | Ishimaru et al. | 72/262 |

FOREIGN PATENT DOCUMENTS

| | | |
|---|---|---|
| 0125788 | 11/1984 | European Pat. Off. . |
| 0127924 | 12/1984 | European Pat. Off. . |
| 0233064 | 8/1987 | European Pat. Off. . |
| 0244254 | 11/1987 | European Pat. Off. . |
| 1452174 | 1/1969 | Fed. Rep. of Germany . |
| 975559 | 3/1951 | France . |
| 54-62960 | 5/1979 | Japan . |
| 55-8342 | 1/1980 | Japan . |
| 2103527A | 2/1983 | United Kingdom . |
| 2221179 | 1/1990 | United Kingdom . |

*Primary Examiner*—Lowell A. Larson
*Attorney, Agent, or Firm*—Shlesinger, Arkwright & Garvey

[57] ABSTRACT

Apparatus for the continuous extrusion of metals in which feed is introduced into two (or more) speed apart circumferential grooves in a rotating wheel (or rotating wheels) to contact an arcuate shoe portion and abutments extending into the grooves. The feed is constrained by the abutments to flow through frusto-conical exit apertures of cone angles in the range of 5°–45° in the shoe portion to a chamber which may also be of the divergent frusto-conical form, and is extruded as relatively thin-walled, large-cross-section products. Mixer plates are profiled to distribute flow evenly from the apertures to around the die opening. An extrusion die body for cylindrical extrusions is located and axially centered by set screws. Where an even number of grooves are utilized, an extrusion mandrel may be secured to the shoe portion by a bolt positioned centrally of the grooves and having a passage for injection of lubricant or oxidation inhibiting fluids. Since the volume feed rate is enhanced and the distance travelled by the material from the grooves is reduced, friction losses and the likelihood of discontinuities arising in extrudate products of relatively large hollow cross-section are thereby reduced.

7 Claims, 7 Drawing Sheets

CONTINUOUS EXTRUSION APPARATUS

This invention relates to apparatus for the forming of metals by a continuous extrusion process in which feed stock is introduced into a circumferential groove in a rotating wheel to pass into a passageway formed between the groove and arcuate tooling extending into the groove. The tooling includes an aperture formed in a shoe portion and extending in a generally radial direction from the groove to a die and an abutment is provided to constrain the feedstock to flow through the aperture and the die.

In EP-A-0125788 there is described continuous extrusion apparatus having a plurality of spaced apart circumferential grooves, arcuate tooling with a shoe portion bounding radially outer portions of the respective grooves provided with exit apertures extending in a generally radial direction from the respective grooves to a chamber and abutments displaced in the direction of rotation from the apertures extending into the grooves, the chamber extending around an extrusion mandrel and discharging axially of the extrusion mandrel through a die orifice intermediate the extrusion mandrel and an extrusion die body wall.

In a continuous extrusion apparatus of the form set out, according to the present invention, the exit apertures are formed with frusto-conical walls smoothly diverging radially outwardly from the face of the shoe portion bounding the grooves to merge smoothly with the chamber.

The invention will now be described, by way of example, with reference to the accompanying, partly diagrammatic, drawings, in which.

Figure 1:
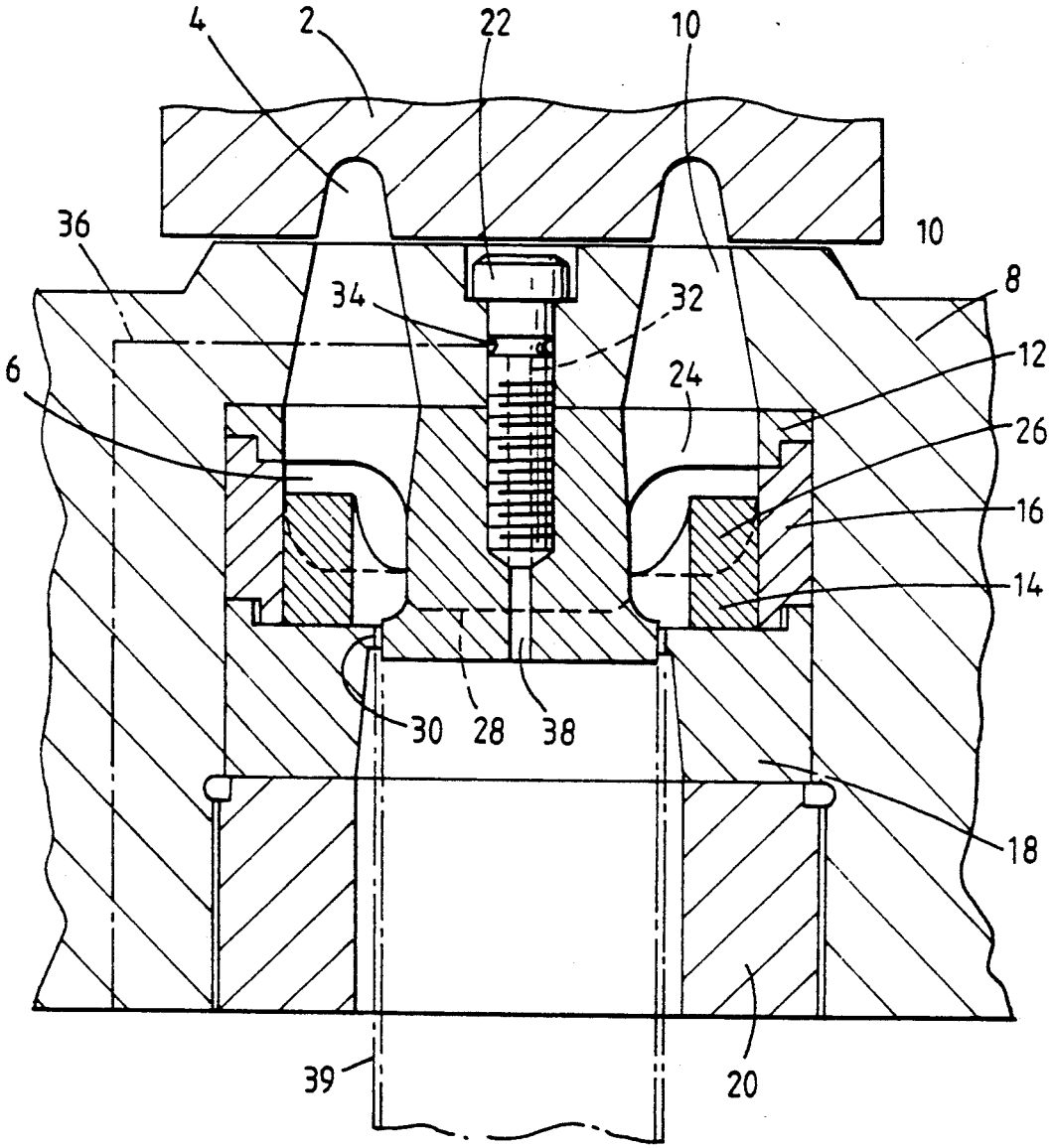
FIG. 1 is a radial cross-section of a portion of a twin grooved rotating wheel and a portion of a shoe showing a die chamber and extrusion mandrel.
Figure 2:
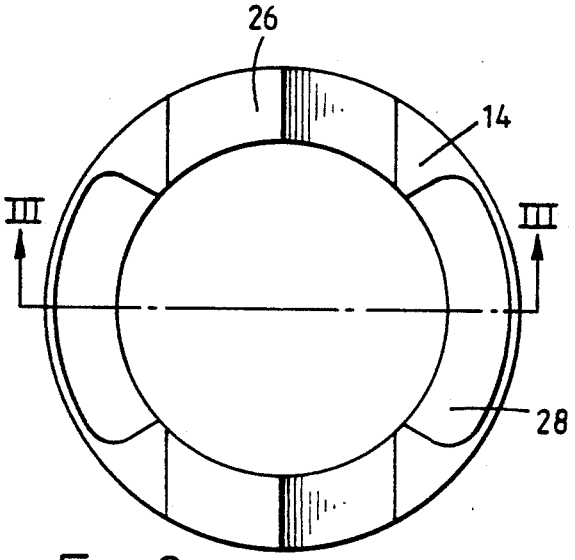
FIG. 2 is end view of a mixer plate positioned in the die chamber.
Figure 3:
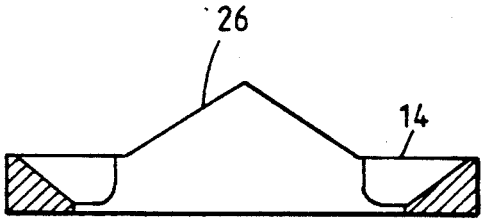
FIG. 3 is a cross-section of the mixer plate taken on the line III—III of FIG. 2.

Referring to FIGS. 1 to 3, in which there is shown an arrangement adapted to produce a large diameter aluminium tube as extrudate, a wheel 2 of a continuous extrusion machine is formed with a pair of axially spaced circumferential grooves 4. A die chamber 6 is formed in a shoe portion 8 of the machine adjacent abutments (not shown) extending into the grooves, and is formed with a pair of divergent, frustoconical, apertures 10 in register with the grooves 4. Positioned in the die chamber 6 is an extrusion mandrel 12, a mixer plate 14, a locating ring 16, an extrusion die 18 and a die support 20. A bolt 22 secures the extrusion mandrel 12 in the die chamber with circumferentially divergent slots 24 in the extrusion mandrel 12 registering with the apertures 10 in the shoe portion 8. As shown in FIGS. 2 and 3, as well as in FIG. 1, the mixer plate 14 is profiled to distribute the flow evenly around the mandrel. Arised protrusions 26 circumferentially divide the flow from the adjacent aperture 10, whilst scalloped portions 28 facilitate the confluence of the adjoining divided flows adjacent an annular gap 30 intermediate the extrusion mandrel 12 and the extrusion die 18.

The bolt 22 is formed with an axial bore 32 communicating, through a radial bore and groove 34, with a supply passage 36 in the shoe portion 8 and, through an axial bore 38 in the extrusion mandrel 12, with the interior of the extrusion. Depending upon requirements, fluid is discharged from the supply passage 36 through the bores 32, 38 to the interior of the extrusion. Thus lubricant to facilitate a subsequent drawing operation utilising a floating mandrel or steam or nitrogen to inhibit oxidation of the interior of the extrusion, may be discharged to the interior of the tube.

In operation, to extrude a thin walled (say between 0.8 and 3 mm), large diameter (say up to 100 mm or even 150 mm) aluminium tube 39, the continuous extrusion machine is operated to produce a flow of material from the grooves 4 into the divergent apertures 10 to impinge upon the protrusions 26 of the mixer plate 14 and to flow evenly through the annular gap 30 to form the tubular extrusion.

Since the grooves 4 are spaced apart and the apertures 10 diverge frusto-conically, a relatively short flow path is required from the grooves to the annular gap 30 to distribute the flow evenly around the gap, the path being shorter than that required if the material originated from a single groove, with a consequent difference in the pressure drops incurred due to resistance to flow in the respective flow paths.

Figure 4:
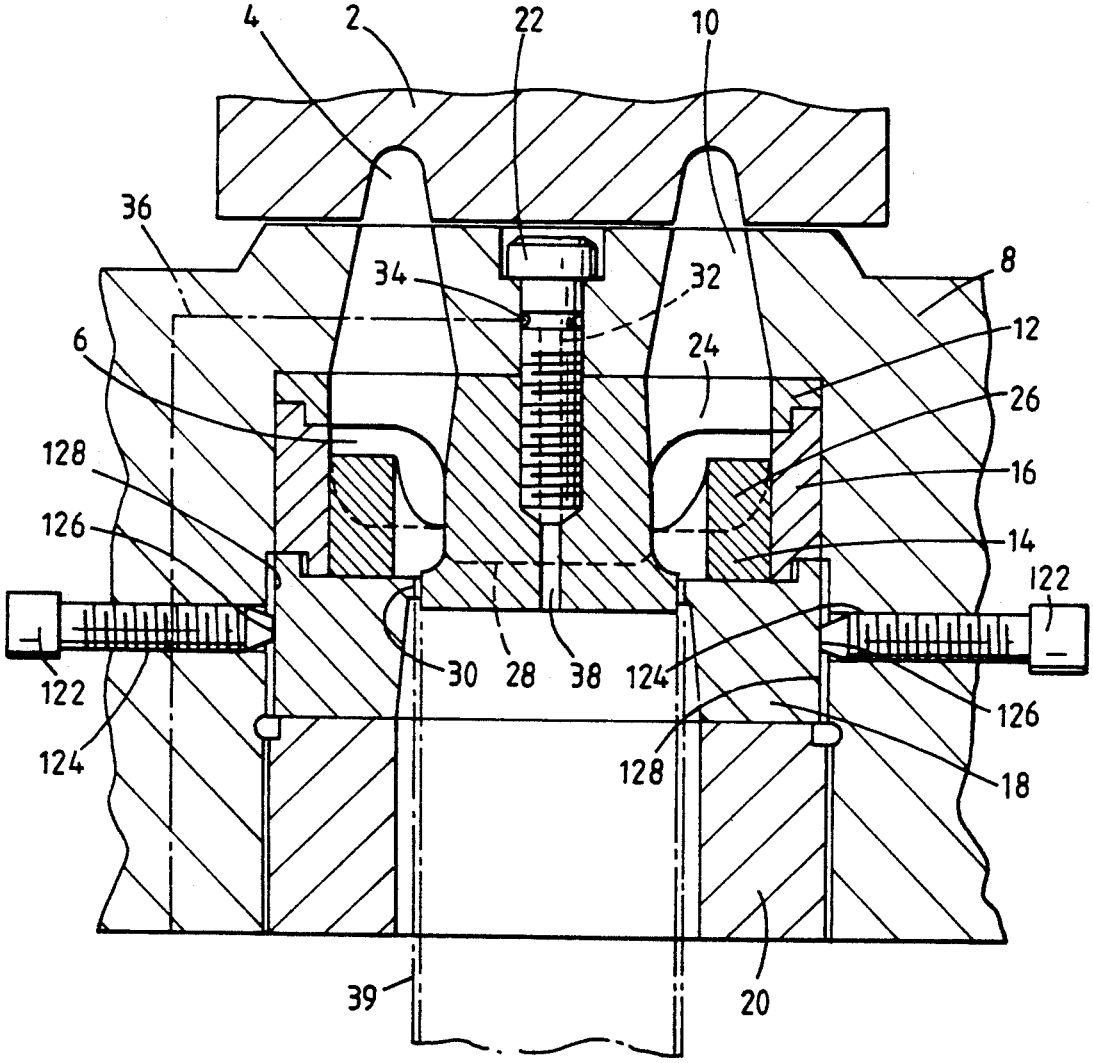
FIG. 4 is a modified form of the arrangement shown in FIG. 1.

In the arrangement shown in FIG. 4, which corresponds to FIG. 1, but modified in that the extrusion die 18 is a loose radial fit in the die chamber 6, six, equiangularly spaced, set screws 122 are positioned in correspondingly threaded radial bores 124 penetrating the wall of the die chamber 6 such that tips 126 of the screws 122 contact the extrusion die 6 at an outer edge face 128 thereof.

On assembly, having secured the extrusion mandrel 12 in the die chamber 6, the locating plate 16 and mixer ring 14 are seated on the extrusion mandrel 12 and, in turn, the extrusion die 18 seated on the locating plate 16 in the die chamber. With three, alternate, set screws 122 backed-off out of contact with the edge face 128 of the extrusion die 18 the remaining initial three set screws are adjusted to centre the extrusion die 18 on the extrusion mandrel 12 in order that the die and mandrel are co-axial and the extrusion die orifice represented by the annular gap 30 is of constant width around the gap. The three original, alternate, set screws 122 are then appropriately tightened to complement the effect of the initial three set screws to locate the extrusion die 18. Finally, the die support 20 is threaded into the die chamber to secure the extrusion die 18 together with the mixer ring 14 and support plate 16 in the die chamber 6.

Operation of this arrangement corresponds to that described in connection with FIGS. 1 to 3.

Figure 6:
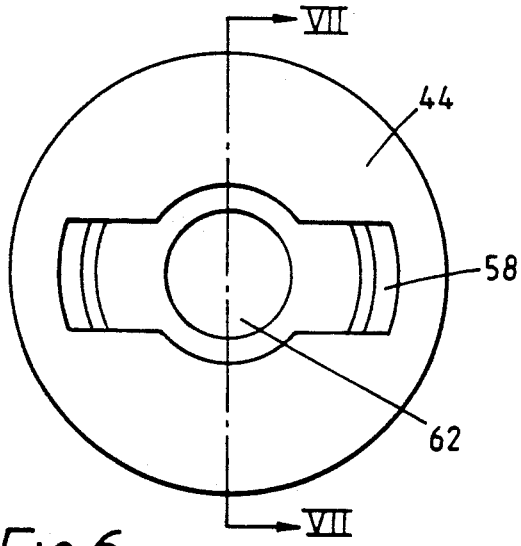
FIG. 6 is end view of a mixer plate positioned in the die chamber shown in FIG. 5.
Figure 7:
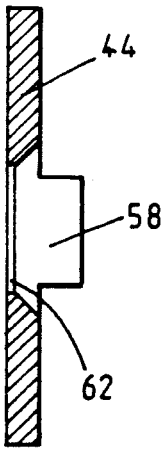
FIG. 7 is a cross-section of the mixer plate taken on the line VII—VII of FIG. 6.
Figure 8:
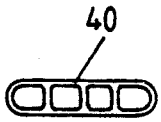
FIG. 8 is a cross-section of extrudate produced in the alternative arrangement shown in FIGS. 5 to 7.

In the alternative arrangement shown in FIGS. 5 to 8 and which is adapted to produce a multi-void section 40 of the form illustrated in FIG. 8 having a wall thickness of 0.8 mm or even 0.4 mm, the wheel 2, grooves 4, die chamber 6, shoe 8 and apertures 10 are similar in form to those described in conjunction with FIG. 1. An extrusion mandrel 42, a mixer plate 44, an extrusion die 48 and a die support 50 are positioned in the die chamber 6. The extrusion mandrel 42 is formed with an extrusion head 52 corresponding to the interior of the multi-void section with slots 54 extending across the head to form the internal webs of the section. Similarly, the extrusion die aperture plate 56 corresponds to the exterior of the multi-void section and, upon assembly, is spaced from the extrusion die head by an amount corresponding to the wall thickness of the section 40 to be extruded.

Figure 5:
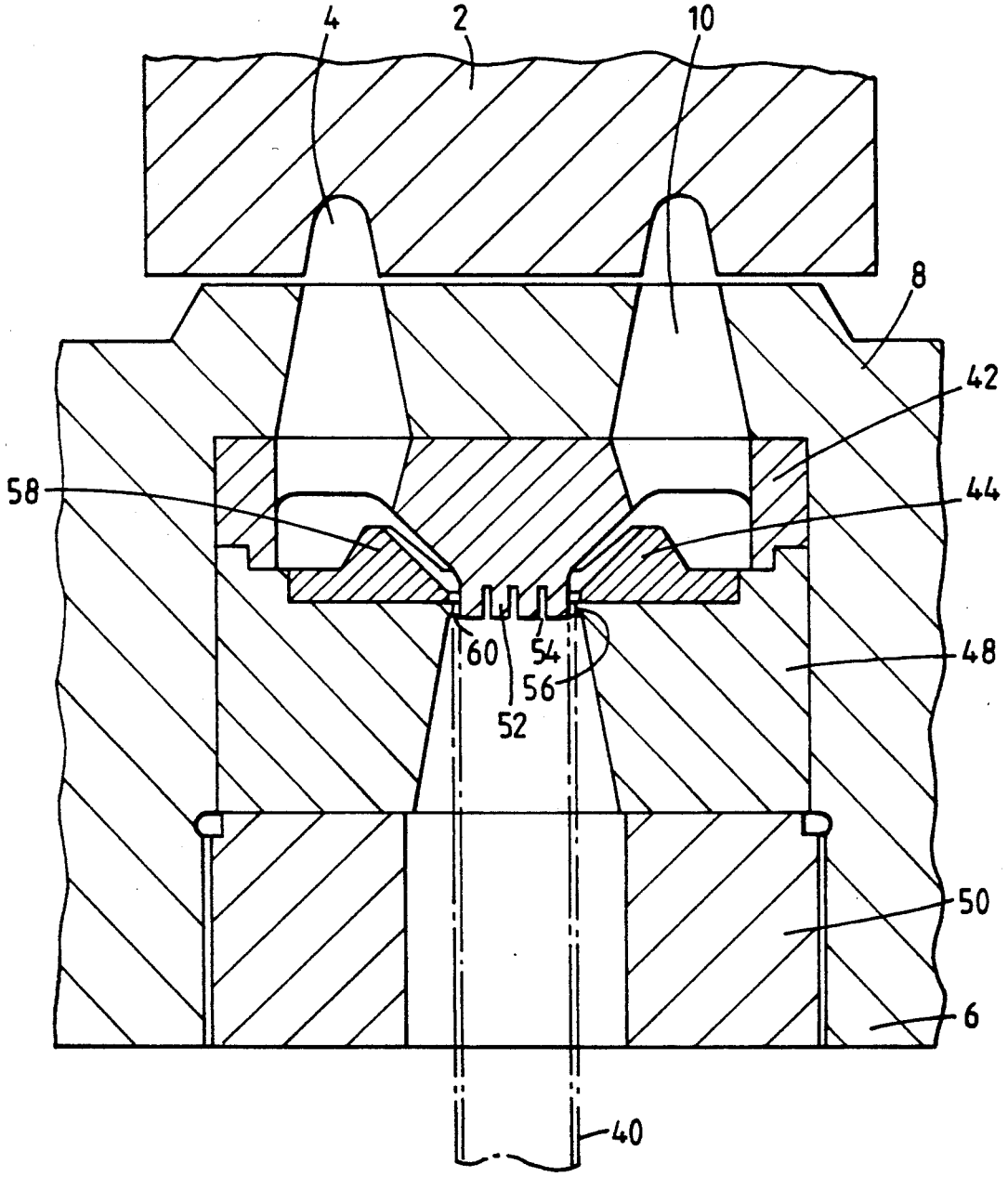
FIG. 5 is a radial cross-section of a portion of a twin grooved rotating wheel and a portion of a shoe showing an alternative form of a die chamber and extrusion mandrel.

As shown in FIGS. 6 and 7, as well as in FIG. 5, the mixer plate 44 is profiled to distribute the flow of material evenly to the gap 60 intermediate the die head 52 and the die aperture plate 56 with raised portions 58 dividing the flow from the respective adjacent aperture 10 and directing the resultant flows to a circular outlet 62 from the mixer plate 44 to flow into the slots 54 in the die head 52 and the gap 60 there to combine to extrude as the section 40 in operation.

Figure 9:
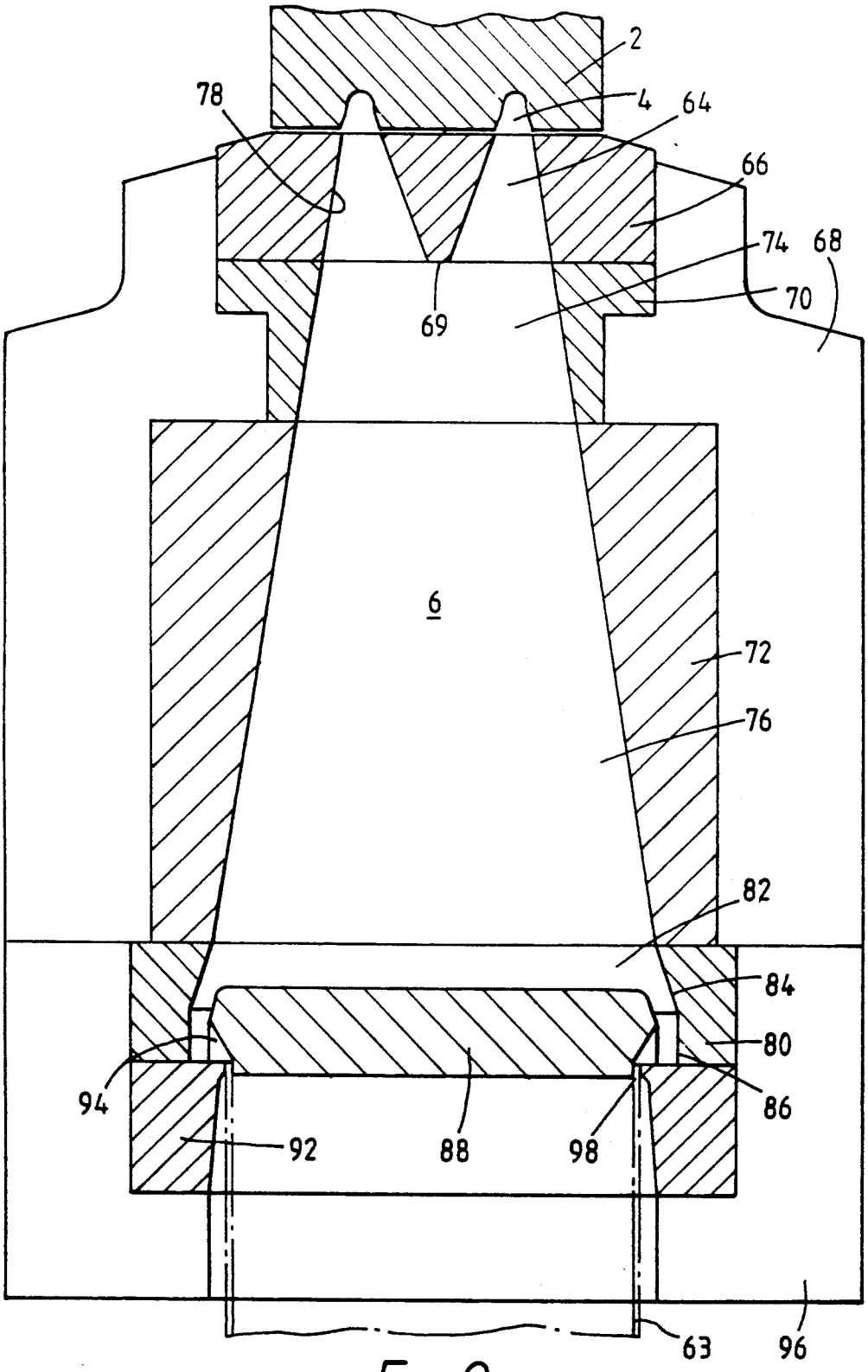
FIG. 9 is a radial cross-section of a portion of a twin grooved rotating wheel and a portion of a shoe showing a further alternative form of a die chamber and extrusion mandrel.

In the further alternative arrangement shown in FIG. 9, there is illustrated an alternative arrangement for the production of thin-walled, large diameter, tube 63. The pair of grooves 4 in the wheel 2 discharge to a pair of eccentric frusto-conical apertures 64 in an abutment block 66 positioned in a shoe portion 68, with adjacent edge portions 69 of the apertures remote from the grooves abutting. A first and a second feeder block 70, 72 each formed with a frusto-conical aperture 74, 76 are also positioned in the shoe portion 68 and each has a cone angle equal to the cone angle of the wall portions 78 diametrically opposed to the adjoining wall portion 69 of the apertures 64 to produce a smoothly diverging face. A third feeder block 80 has an aperture 82 with an initial face 84 of frusto-conical form—but of greater cone angle than the apertures 74, 76—and an outer face 86 of cylindrical form extending around an external mandrel 88 positioned on a die 92 by means of webs 94, the third feeder block 80 and the die 92 being located on the shoe portion 68 by means of a die support ring 96.

In operation, material urged from the grooves 4 by abutment stops (not shown) flows into the apertures 64 in the abutment block 66 and thence smoothly through the apertures 74, 76 and 82 in the first, second and third feeder blocks 70, 72 and 80 to extrude smoothly and evenly through the annular gap 98 intermediate the mandrel 88 and the die 92, confluence occurring immediately downstream of the webs 94, to produce a thin-walled, large diameter, tube 63. The cone angles are selected to give a divergence to the diameter appropriate to the die 92 within a minimum radial distance from the grooves 4 commensurate with maintaining a smooth and even extrusion material flow. The feeder blocks 70, 72, 80 have the effect of extending the radial dimension of the flow path beyond the thickness of the shoe portion and hence enable the extrusion of a product of greater cross-sectional dimension than would otherwise be possible with a given extrusion machine.

Figure 10:
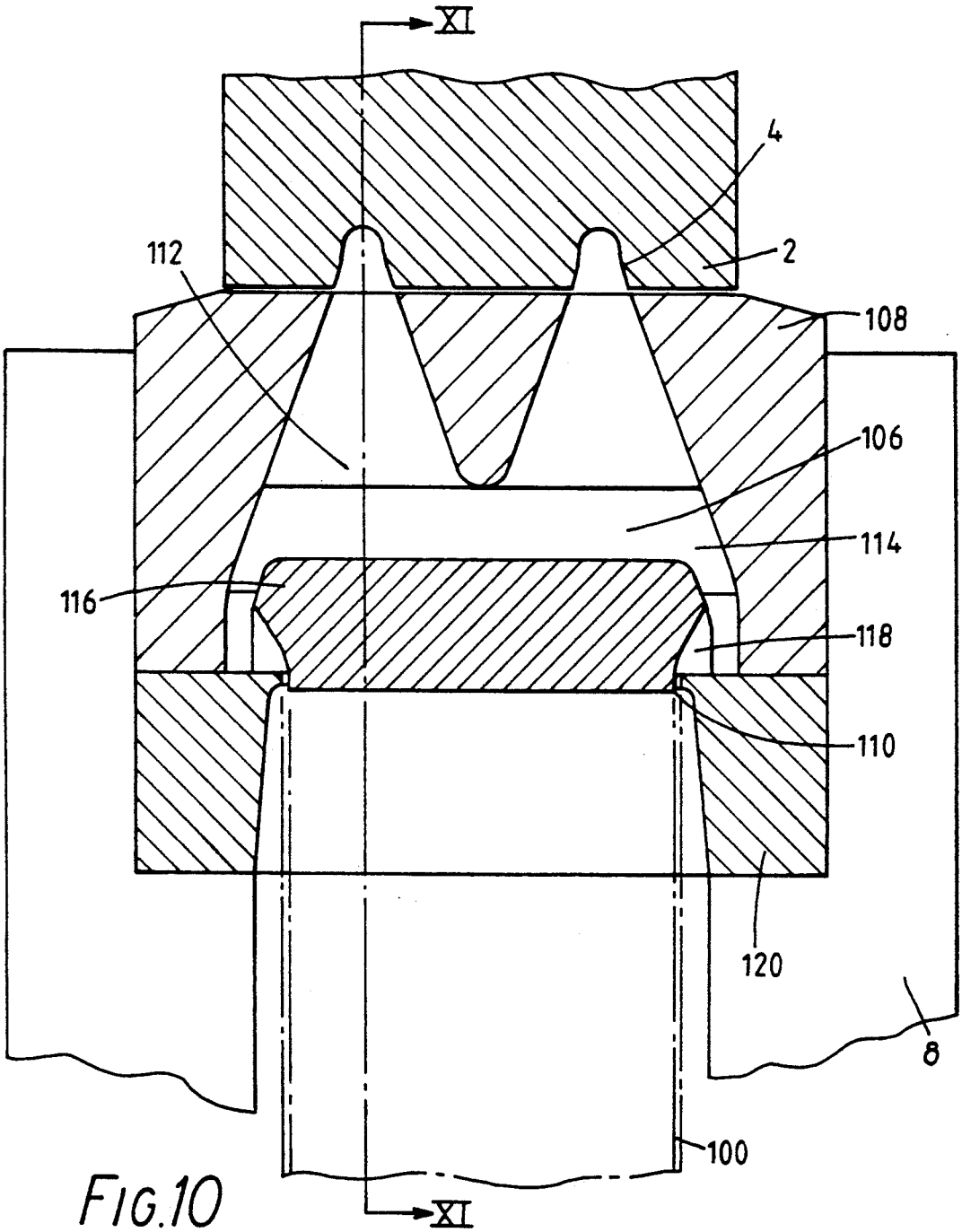
FIG. 10 is a radial cross-section of a portion of a twin grooved rotating wheel and a portion of a shoe showing a yet further alternative form of a die chamber and extrusion mandrel.
Figure 12:
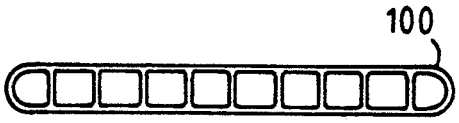
FIG. 12 is a cross-section of extrudate produced in the yet alternative arrangement shown in FIGS. 10 and 11.
Figure 11:
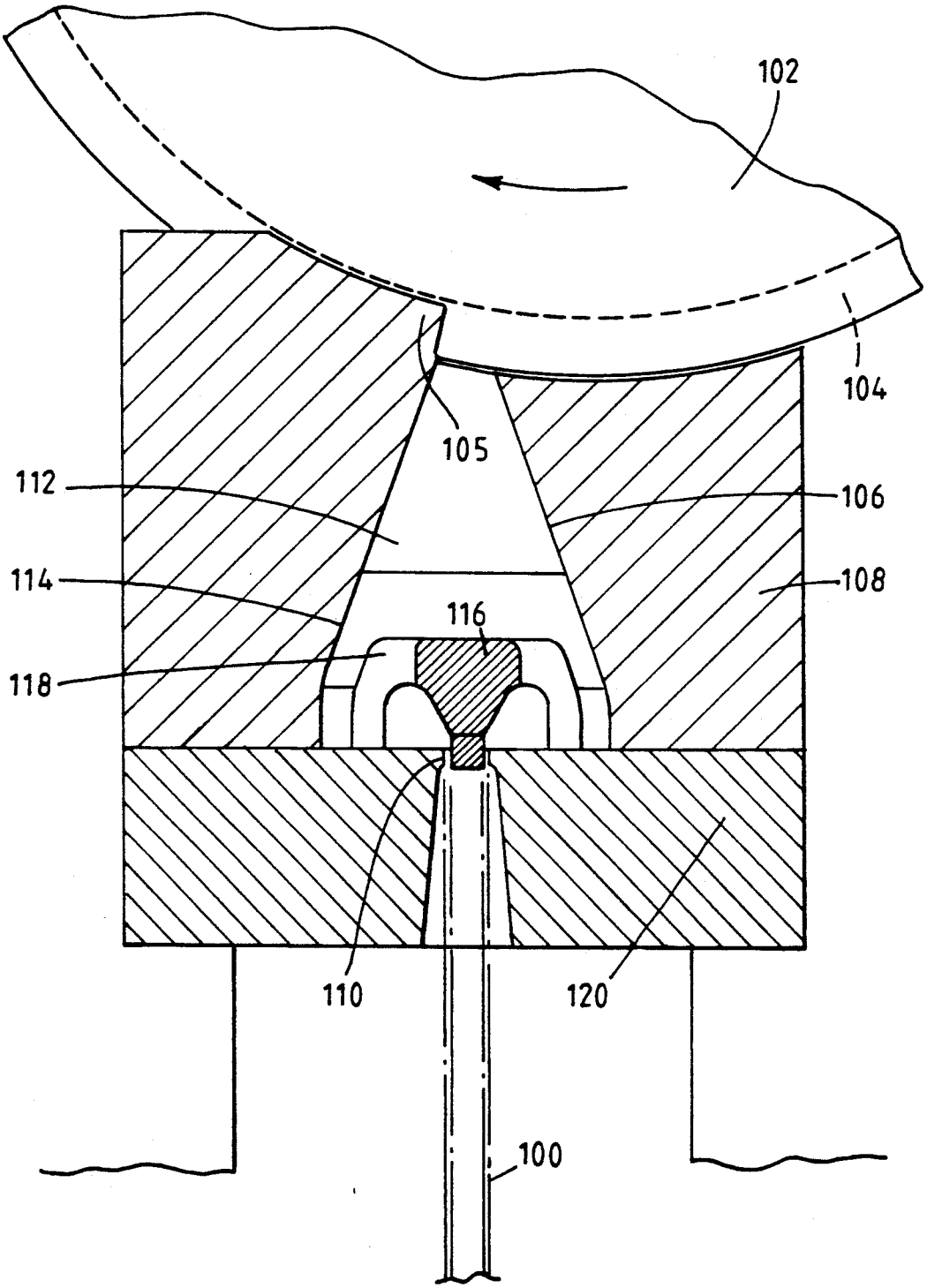
FIG. 11 is a cross-section taken on the line XI—XI of FIG. 10.

In the yet further alternative arrangement shown in FIGS. 10, 11 and 12, and which is adapted to extrude a multi-void section product 100 illustrated in FIG. 11, a wheel 2 formed with divergent walled grooves 4 provided with abutments 105 discharges to a divergent chamber 106 in an abutment block 108 supplying a die orifice 110 corresponding to the multi-void section product 100. The chamber 106 includes a pair of frusto-conical portions 112, each having a cone angle corresponding to the angle of divergence of the walls of the grooves 104, merging smoothly into a divergent portion 114 having an elliptical cross-section with major axis aligned with a major axis of a mandrel 116 supported by webs 118 on an extrusion die 120.

In operation, material urged from the grooves 4 by abutment stops 105 flows into the frusto-conical portions 112 and thence smoothly into the divergent portion 114 to the extrusion orifice 110 formed intermediate the mandrel 116 and the extrusion die 120 to extrude smoothly and evenly therethrough, with confluence occurring downstream of the webs 100. The divergence of the groove walls and the chamber 106 are selected to accommodate the form of the multi-void section product 100 at a minimum radial distance from the grooves 4 commensurate with maintaining a smooth and even extrusion material flow.

It will be understood that, in each of the foregoing embodiments, by providing a pair of grooves supplying feedstock to the extrusion die it is possible to extrude products of relatively large cross-section dimension since the volume rate of feedstock supplied is greater than that attainable with a single groove supply and the radial distance that the feedstock flows between the wheel and the extrusion die is less, bearing in mind that if the passage between the wheel and the extrusion die diverges at too great an angle serious discontinuities in the flow are likely to arise.

Angles of divergence of between 5° and 45° have been found effective, a suitable range being between 10° and 30° with a preferred range of between 15° and 20°. Using such angles of divergence, it has been found that the reduction in pressure drop along a divergent frusto-conical aperture between an arrangement utilising a single extrusion source and an arrangement utilising a plurality of extrusion sources approximates to the ratio of the difference between the final extrusion diameter and the sum of the diameters of each of the extrusion sources to the sum of the final extrusion diameter and the diameters of each of the extrusion sources.

It will be appreciated that these advantages may be enhanced by utilising a multiplicity of grooves in the wheel so long as such provision does not unduly complicate requirements of feedstock supply or unduly increase power requirements.

Where an even number of grooves is utilised, securing of an extrusion mandrel in position in the shoe portion by means of a central bolt extending from the face of the shoe portion adjacent the wheel is facilitated. As a result, the supply of fluid to the interior of the extended product is also facilitated. In addition, replacement of the mandrel to form extrusion products of different cross-section is also facilitated.

Whilst a single wheel having a plurality of grooves has been described, it will be appreciated that, if desired, a plurality of wheels each with one, or more, grooves may be utilised.

We claim:

1. Continuous extrusion apparatus, comprising:

a) a rotatable wheel formed with a plurality of identical spaced apart circumferential grooves;

b) arcuate tooling having a shoe portion bounding radially outer portions of the respective grooves provided with exit apertures extending in a generally radial direction from the respective grooves to a die chamber and abutments displaced in the direction of rotation from the exit apertures extending into the grooves, the die chamber extending around an extrusion mandrel and discharging axially of the extrusion mandrel through a die orifice intermediate the extrusion mandrel and an extrusion die body wall;

c) the exit apertures are formed with frusto-conical walls smoothly diverging radially outwardly from a face of the shoe portion bounding the grooves to merge smoothly with the die chamber adjacent to the die orifice such that the cross-sectional area of each exit aperture increases progressively from the grooves toward the die orifice; and d) a mixer plate positioned in the die chamber and profiled with arised protrusions respectively in register with aligned exit apertures and with intervening scalloped portions directed toward the extrusion mandrel and die orifice.

2. Continuous extrusion apparatus as claimed in claim 1, wherein:

a) the exit apertures have an angle of divergence in the range of 5° to 45°.

3. Continuous extrusion apparatus as claimed in claim 1, wherein:

a) the exit apertures have an angle of divergence in the range of 10° to 30°.

4. Continuous extrusion apparatus as claimed in claim 1, wherein:

a) the exit apertures have an angle of divergence in the range of 15° to 20°.

5. Continuous extrusion apparatus as claimed in claim 1, wherein:

a) an even number of spaced apart circumferential grooves are formed in the rotatable wheel and the extrusion mandrel is secured to the shoe portion by means of a bolt extending radially through the shoe portion from a face normally abutting a portion of the wheel central of the grooves.

6. Continuous extrusion apparatus as claimed in claim 5, wherein:

a) a fluid supply passage discharging to the interior of a hollow extrudate extends through the die to a bore in the bolt communicating through a radial tapping with a duct in the associated shoe portion from a connecting junction on the exterior of the shoe portion.

7. Continuous extrusion apparatus as claimed in claim 1, wherein:

a) the extrusion die body is located and axially centered in an associated wall portion of the chamber by means of a multiplicity of equi-angularly spaced set screws extending through threaded, radial bores in the associated wall portion.

* * * * *